US010246316B1

(12) United States Patent
Winters et al.

(10) Patent No.: US 10,246,316 B1
(45) Date of Patent: Apr. 2, 2019

(54) ANTI-SPILL FUNNEL ASSEMBLY

(71) Applicants: Nathan D. Winters, South Sioux City, NE (US); John A. Cain, South Sioux City, NE (US); Samuel R. White, South Sioux City, NE (US)

(72) Inventors: Nathan D. Winters, South Sioux City, NE (US); John A. Cain, South Sioux City, NE (US); Samuel R. White, South Sioux City, NE (US)

(73) Assignee: J.N.S. TECHNOLOGIES, LLC, South Sioux City, NE (US)

( * ) Notice: Subject to any disclaimer, the term of this patent is extended or adjusted under 35 U.S.C. 154(b) by 146 days.

(21) Appl. No.: 15/649,136

(22) Filed: Jul. 13, 2017

(51) Int. Cl.
*B67C 11/02* (2006.01)
*B67C 11/06* (2006.01)
*B67C 11/00* (2006.01)

(52) U.S. Cl.
CPC ..... *B67C 11/02* (2013.01); *B67C 11/063* (2013.01); *B67C 2011/027* (2013.01); *B67C 2011/30* (2013.01)

(58) Field of Classification Search
CPC ..... B67C 11/02; B67C 2011/027; B67C 2011/30; B67C 11/063
USPC ..... 141/339
See application file for complete search history.

(56) References Cited

U.S. PATENT DOCUMENTS 868,394 A * 10/1907 Ash ..... B67C 11/02 141/299
2,902,062 A * 9/1959 Von Smekal ..... B67C 11/02 141/105
4,850,403 A * 7/1989 Wiese ..... B67C 11/02 141/95
5,787,944 A * 8/1998 Sarkis ..... B67C 11/02 141/300
6,119,739 A * 9/2000 McGee ..... B67C 11/02 141/299
2012/0305125 A1* 12/2012 Nirmel ..... B67C 11/02 141/1

* cited by examiner

*Primary Examiner* — Marina A Tietjen
*Assistant Examiner* — Paul J Gray
(74) *Attorney, Agent, or Firm* — Dennis L. Thomte; Thomte Patent Law Office LLC

(57) ABSTRACT

An anti-spill funnel assembly which includes an outer reservoir funnel having a center funnel positioned therein. The outer reservoir funnel includes a cone-shaped portion having a spout extending downwardly therefrom. The center funnel includes a cone-shaped portion having a hollow stem extending downwardly therefrom. This center funnel also includes a spout extending downwardly from the lower end of the cone-shaped portion thereof. The hollow stem portion has a plurality of vertically disposed slots formed therein. When the funnel assembly is being used to fill a container or a piece of equipment, the spouts of the reservoir funnel and center funnel are inserted downwardly into the fill opening of a container or equipment. As liquid is poured into the container or equipment, any overflow liquid is passed upwardly into the outer reservoir funnel to prevent a spill.

4 Claims, 5 Drawing Sheets

ANTI-SPILL FUNNEL ASSEMBLY

BACKGROUND OF THE INVENTION

Field of the Invention

This invention relates to an anti-spill funnel assembly and more particularly to an anti-spill funnel assembly which includes an outer reservoir funnel having a center funnel positioned therein. Even more particularly, this invention relates to an anti-spill funnel assembly for preventing the spillage of liquid when the funnel assembly is being used to fill a container with liquid or to fill the gas tank of a piece of equipment.

Description of the Related Art

Funnels have long been used to pour liquids into a container or equipment having a fill opening structure which is normally selectively closed by a cap or the like. The spout of the funnel is usually inserted downwardly into the fill opening until the lower end of the cone-shaped portion or apex of the funnel engages the upper end of the fill opening structure. Liquid is then poured into the funnel to fill the container or the tank of a piece of equipment. If the container or tank is overfilled, a liquid spill occurs.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

An anti-spill funnel assembly is disclosed which includes an outer reservoir funnel having a center funnel positioned therein. The outer reservoir funnel includes:

(a) a hollow cone-shaped portion having an upper end, a lower end, an outer surface, and an inner surface;
(b) a hollow inwardly tapered spout having an upper end, a lower end, an outer surface, and an inner surface;
(c) the upper end of the tapered spout being joined to the lower end of the cone-shaped portion;
(d) the tapered spout extending outwardly and downwardly at an angle from the lower end of the cone-shaped portion to define a first interior shoulder therebetween;
(e) a plurality of elongated and radially spaced-apart first ribs, having upper and lower ends, extending outwardly from the outer surface of the cone-shaped portion, at the lower end thereof, and the outer surface of the tapered spout.

the center funnel includes:

(a) a cone-shaped portion having an upper end, a lower end, an outer surface and an inner surface;
(b) the upper end of the cone-shaped portion of the center funnel has a diameter which is less than the diameter of the reservoir funnel;
(c) a hollow stem portion having an upper end, a lower end, an inner surface and an outer surface;
(d) the upper end of the hollow stem portion is joined to the lower end of the cone-shaped portion of the center funnel;

(e) the hollow stem portion has an outwardly tapered portion, at the lower end thereof, which has upper and lower ends;
(f) a plurality of elongated and radially spaced-apart second ribs, having upper and lower ends, which extend outwardly from the outer surface of the cone-shaped portion of the center funnel, at the lower end thereof, and the outer surface of the hollow stem portion at the upper end thereof;
(g) a hollow spout portion having upper and lower ends;
(h) the hollow spout portion of the center funnel includes an inwardly tapered portion, having upward and lower ends, at the upper end thereof;
(i) the upper end of the inwardly tapered portion of the hollow support portion of the center funnel is joined to the lower end of the stem portion thereof to define an exterior shoulder therebetween;
(j) the lower end of the spout portion of the center funnel is inwardly tapered; and
(k) a plurality of elongated and radially spaced-apart openings, having upper and lower ends, formed in the stem portion.

The exterior shoulder between the lower end of the stem portion of the center funnel and the inwardly tapered portion of the spout portion of the center funnel engaging the interior surface of the spout of the outer reservoir funnel to limit the downward movement of the center funnel with respect to the reservoir funnel to an operative fill position. When the center funnel is in its operative fill position within the reservoir funnel:

(a) the cone-shaped portions of the outer reservoir funnel and the center funnel are spaced-apart;
(b) the exterior shoulder preventing the overfill fluid from passing upwardly from the lower end of the tapered spout of the outer reservoir funnel;
(c) the openings in the stem portion permitting the overfill liquid to pass outwardly therefrom into the lower end of the cone-shaped portion of the outer reservoir funnel thereby preventing liquid from being spilled.

It is therefore a principal object of the invention to provide an improved anti-spill funnel assembly.

A further object of the invention is to provide an anti-spill funnel assembly which includes an outer reservoir funnel having a center funnel positioned therein.

A further object of the invention is to provide an anti-spill funnel assembly which is economical of manufacture, durable in use and refined in appearance.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

Figure 10:
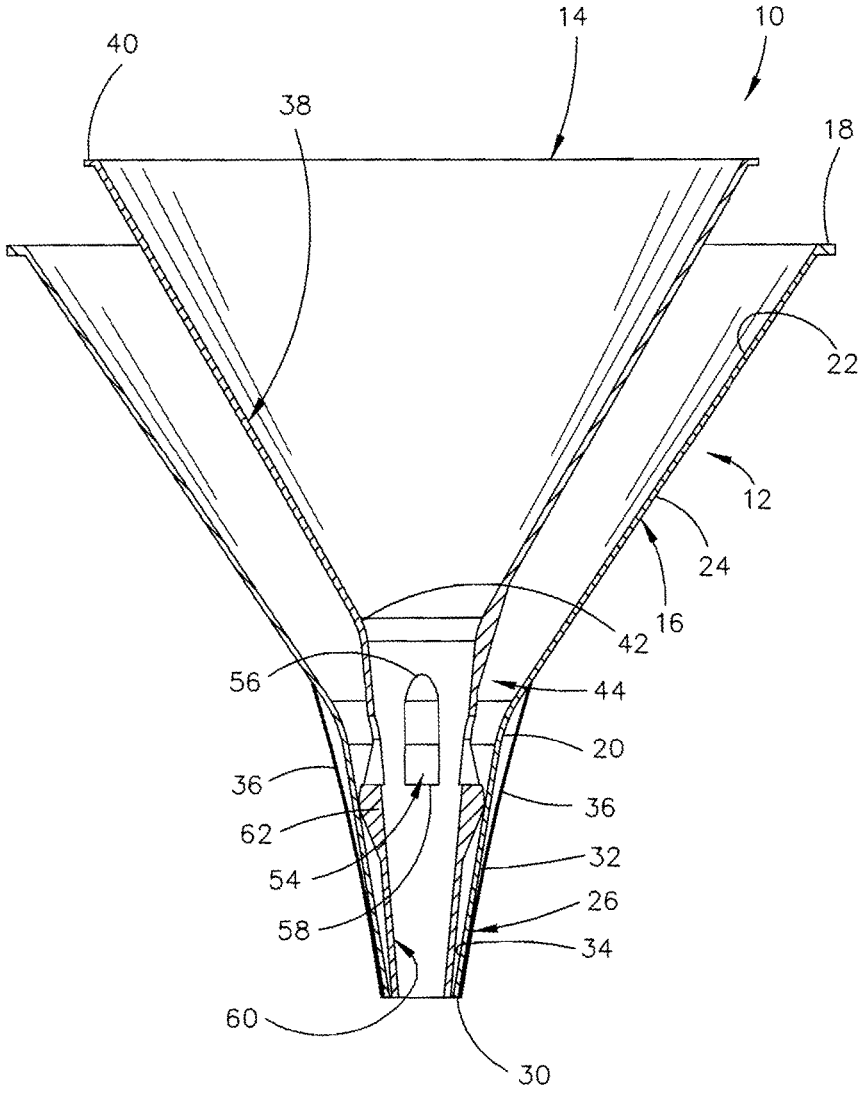
FIG. 10 is a sectional view of the funnel assembly of this invention.

The numeral 10 refers to the funnel assembly of this invention. Funnel assembly includes a reservoir funnel 12 and a center funnel 14. Funnel 12 is of traditional or conventional design and includes a cone-shaped portion 16 having an upper end 18 and a lower end 20. For purposes of description, the cone-shaped portion 16 will be described as having an inner surface 22 and an outer surface 24. A tapered hollow spout 26 extends downwardly from the lower end 20 of cone-shaped portion 16 in conventional fashion. Spout 26 will be described as having an upper end 28, a lower end 30, an outer surface 32 and an inner surface 34. Preferably, the outer surface 32 of spout 26 has a plurality of elongated and radially spaced-apart ribs 36 which protrude outwardly therefrom. As seen in FIG. 10, the upper ends of the ribs 36 have a greater thickness than the lower ends of the ribs 36 so as to protrude further outwardly from the outer surface 32 than do the lower ends of the ribs 36. As seen in FIG. 10, the upper ends of the ribs are positioned at the outer side of the lower end 20 of cone-shaped portion 16. If so desired, a handle could be secured to the upper end 18 of cone-shaped portion 16 so as to extend outwardly therefrom.

Figure 1:
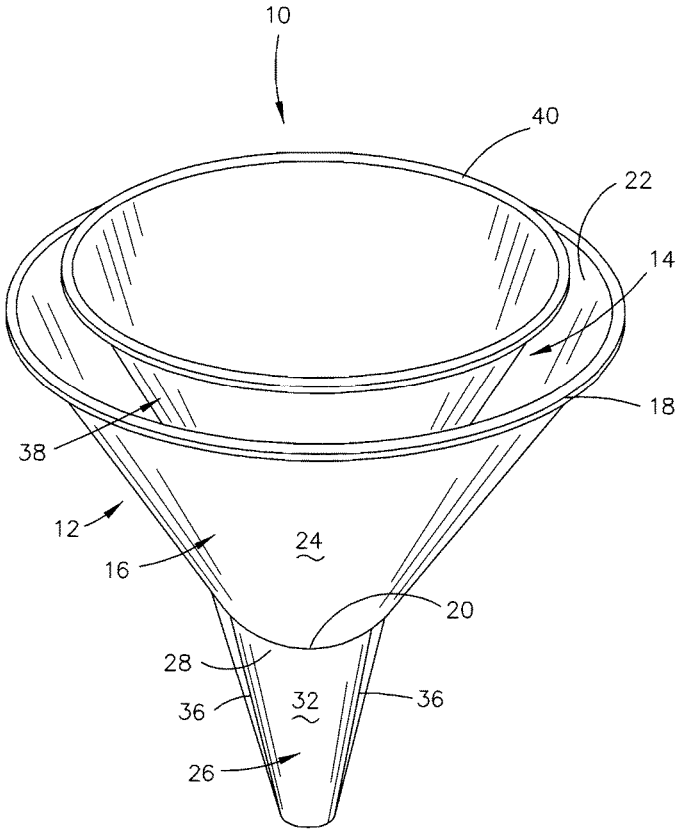
FIG. 1 is a perspective view of the funnel assembly of the invention.
Figure 2:
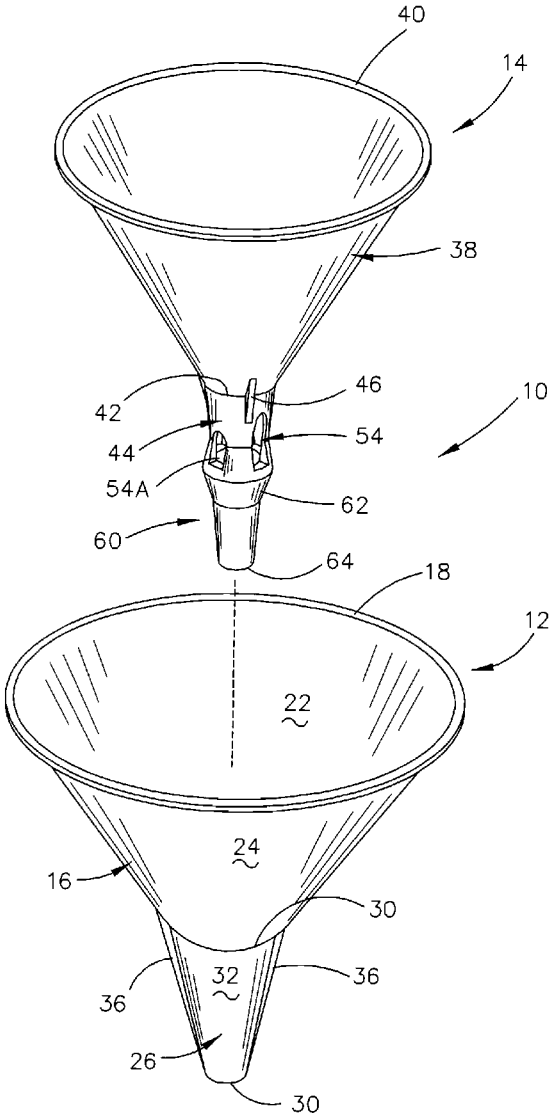
FIG. 2 is an exploded perspective view of the funnel assembly of this invention.
Figure 3:
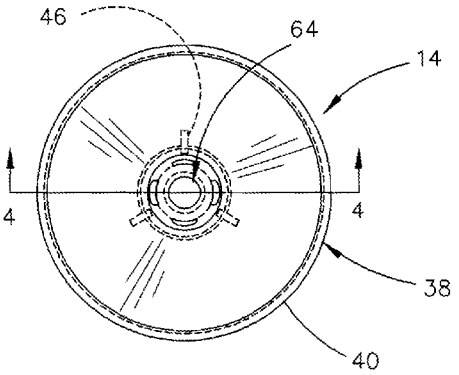
FIG. 3 is a top elevational view of the center funnel of the funnel assembly of this invention.
Figure 4:
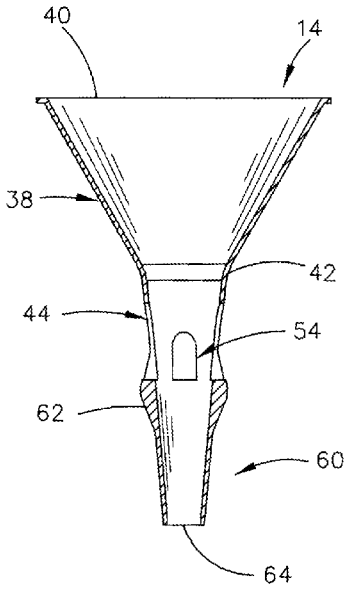
FIG. 4 is a sectional view of the center funnel as seen on lines 4-4 of FIG. 3.
Figure 5:
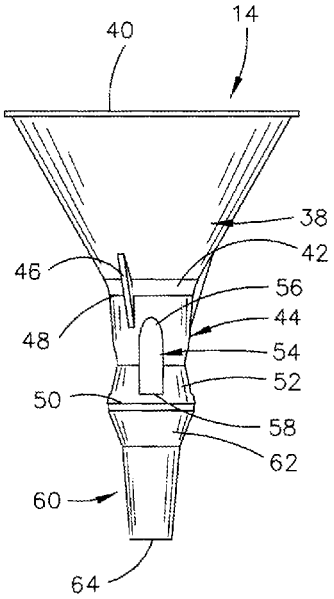
FIG. 5 is a side view of the center funnel of the funnel assembly of this invention.
Figure 6:
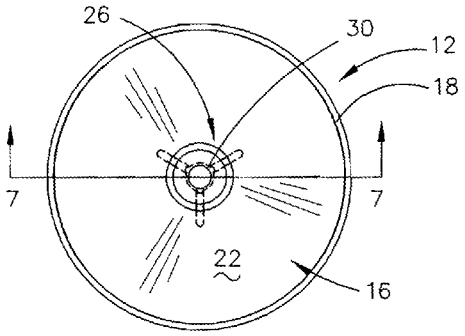
FIG. 6 is a top elevational view of the outer funnel of the funnel assembly of this invention.
Figure 7:
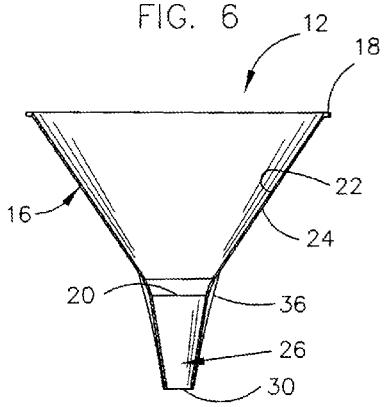
FIG. 7 is a sectional view of the outer funnel as seen on lines 7-7 of FIG. 6.
Figure 8:
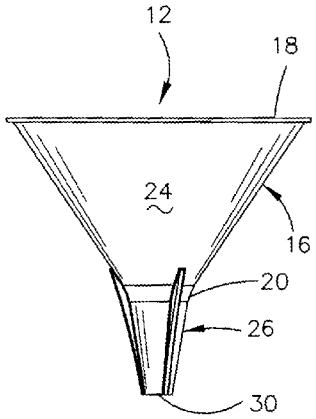
FIG. 8 is a side view of the outer funnel of the funnel assembly of this invention.
Figure 9:
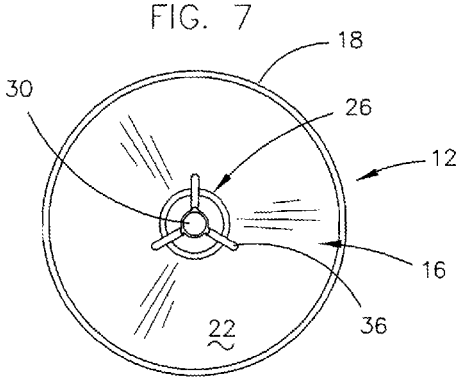
FIG. 9 is a bottom view of the outer funnel of the funnel assembly of this invention.

Funnel 14 includes a cone-shaped portion 38 having an upper end 40 and a lower end 42. Funnel 14 also includes a stem portion 44 which is molded with cone-shaped portion 38 and which extends downwardly therefrom. A plurality of radially spaced-apart ribs 46 extend outwardly from the outer surfaces of cone-shaped portion 38 and stem 44 at the junction thereof as seen in FIGS. 2 and 5. Stem 44 will be described as having an upper end 48 and a lower end 50. As seen in FIG. 5, stem 44 has an outwardly tapered portion 52 at its lower end. Stem 44 has a plurality of elongated and radially spaced-apart openings or slots 54 formed therein. Each of the openings 54 will be described as having an upper end 56 and a lower end 58. As seen in FIGS. 4 and 5, some of the openings 54 are shorter than the other openings 54. The shorter openings will be identified with the numeral 54A.

A tapered hollow spout 60 extends downwardly from the lower end 50 of stem 44. As seen in FIGS. 4 and 5, spout 60 has an enlarged upper end portion which defines a shoulder 62. Spout 60 has an open lower end 64.

As seen, the diameter of the cone-shaped portion 38 of center funnel 14 is less than the inner diameter of reservoir funnel 12 and the outer diameter of spout 60 of center funnel 14 is less than the inner diameter of spout 26 of reservoir funnel 12 so that the center funnel 14 may be positioned in reservoir funnel 12 as seen in FIG. 10. In the position of FIG. 10, the shoulder 62 of spout 60 of center funnel 14 engages the inner surface 34 of spout 26 and that the lower ends 30 of spout 26 dwells in the same plane as lower end 64 of spout 60. In that position, the slots 54 and 54A are above the shoulder 62. As also seen in FIG. 10, the slots 54 and 54A communicate with the interior of the upper end of spout 26.

The funnel assembly 10 is used as follows. After the center funnel 14 has been positioned in reservoir funnel 12 as previously described and as shown in FIG. 10, the lower end of spouts 26 and 60 are inserted downwardly into the fill opening of the container or equipment until the ribs 36 engage the fill opening structure. The ribs 36 not only help to stabilize the funnel assembly 10 in the fill opening of the container but also provide a means for venting the air from within the container as liquid is poured into the center funnel 14. If the container should be overfilled with liquid being poured thereinto, the liquid in the container will back upwardly within spout 60. When the overfill liquid backs upwardly, the liquid within spout 60 and stem portion 44 will flow outwardly through the slots 54 and 54A into the space between center funnel 14 and the reservoir funnel 12.

The person pouring the liquid into center funnel 14 will see the liquid rising between the center funnel 14 and the reservoir funnel 12 and will discontinue the pouring process. The funnel assembly 10 may then be raised with respect to the container until the person can place his/her finger beneath the lower ends 30 and 64 of spouts 26 and 60 respectively to prevent any spillage of the liquid therefrom. The excess liquid may then be disposed as seen fit.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

We claim:

1. An anti-spill funnel assembly for preventing the spill of fluid when the funnel assembly is being used to fill a container with fluid, comprising:

an outer reservoir funnel including:

(a) a hollow cone-shaped portion having an upper end, a lower end, an outer surface, and an inner surface;

(b) a hollow inwardly tapered spout having an upper end, a lower end, an outer surface, and an inner surface;

(c) said upper end of said tapered spout being joined to said lower end of said cone-shaped portion;

(d) said upper end of said cone-shaped portion having a first diameter;

(e) said lower end of said cone-shaped portion having a second diameter which is less than said first diameter;

(f) said tapered spout extending outwardly and downwardly at an angle from said lower end of said cone-shaped portion to define a first interior shoulder therebetween;

(g) a plurality of elongated and radially spaced-apart first ribs, having upper and lower ends, extending outwardly from said outer surface of said cone-shaped portion, at said lower end thereof, and said outer surface of said tapered spout;

a center funnel positioned in said outer funnel;

said center funnel including:

(a) a cone-shaped portion having an upper end, a lower end, an outer surface, and an inner surface;

(b) said upper end of said cone-shaped portion of said center funnel having a diameter which is less than said first diameter of said upper end of said cone-shaped portion of said outer reservoir funnel;

(c) said lower end of said cone-shaped portion of said center funnel having a diameter which is less than said second diameter of said lower end of said cone-shaped portion of said outer reservoir funnel;

(d) a hollow stem portion having an upper end, a lower end, an inner surface and an outer surface;

(e) said upper end of said hollow stem portion being joined to said lower end of said cone-shaped portion of said center funnel;

(f) said hollow stem portion having an outwardly tapered portion, at said lower end thereof, having upper and lower ends;

(g) a plurality of elongated and radially spaced-apart second ribs, having upper and lower ends, extending outwardly from said outer surface of said cone-shaped portion of said center funnel, at said lower end thereof, and said outer surface of said hollow stem portion at said upper end thereof;

(h) a hollow spout portion having upper and lower ends;

(i) said hollow spout portion of said center funnel including an inwardly tapered portion, having upper and lower ends, at said upper end thereof;

(j) said upper end of said inwardly tapered portion of said spout portion of said center funnel being joined to said lower end of said stem portion thereof to define an exterior shoulder therebetween;

(k) said lower end of said spout portion of said center funnel being inwardly tapered;

(l) a plurality of elongated and radially spaced-apart openings, having upper and lower ends, formed in said stem portion;

said exterior shoulder between said lower end of said stem portion of said center funnel and said tapered portion of said spout portion of said center funnel engaging said interior surface of said spout of said outer reservoir funnel to limit the downward movement of said center funnel with respect to said outer reservoir funnel to an operative fill position;

when said center funnel is in said operative fill position:

(a) said cone-shaped portions of said outer reservoir funnel and said center funnel are spaced-apart;

(b) said exterior shoulder preventing overfill fluid from passing upwardly from said lower end of said tapered spout of said outer reservoir funnel;

(c) said openings in said stem portion permitting overfill liquid to pass outwardly therethrough into said lower end of said cone-shaped portion of said outer reservoir funnel thereby preventing liquid from being spilled.

2. The anti-spill funnel assembly of claim 1 wherein said upper ends of said first ribs have a greater thickness than said lower ends thereof.

3. An anti-spill funnel assembly for preventing the spill of fluid when the funnel assembly is being used to fill a container with fluid, comprising:

an outer reservoir funnel including:

(a) a hollow cone-shaped portion having an upper end, a lower end, an outer surface, and an inner surface;

(b) a hollow inwardly tapered spout having an upper end, a lower end, an outer surface, and an inner surface;

(c) said upper end of said tapered spout being joined to said lower end of said cone-shaped portion;

(d) said upper end of said cone-shaped portion having a first diameter;

(e) said lower end of said cone-shaped portion having a second diameter which is less than said first diameter;

(f) said tapered spout extending outwardly and downwardly at an angle from said lower end of said cone-shaped portion to define a first interior shoulder therebetween;

(g) a plurality of elongated and radially spaced-apart first ribs, having upper and lower ends, extending outwardly from said outer surface of said cone-shaped portion, at said lower end thereof, and said outer surface of said tapered spout;

a center funnel positioned in said outer funnel;

said center funnel including:

(a) a cone-shaped portion having an upper end, a lower end, an outer surface, and an inner surface;

(b) said upper end of said cone-shaped portion of said center funnel having a diameter which is less than said first diameter of said upper end of said cone-shaped portion of said outer reservoir funnel;

(c) said lower end of said cone-shaped portion of said center funnel having a diameter which is less than said second diameter of said lower end of said cone-shaped portion of said outer reservoir funnel;

(d) a hollow stem portion having an upper end, a lower end, an inner surface and an outer surface;

(e) said upper end of said hollow stem portion being joined to said lower end of said cone-shaped portion of said center funnel;

(f) said hollow stem portion having an outwardly tapered portion, at said lower end thereof, having upper and lower ends;

(g) a hollow spout portion having upper and lower ends;

(h) said hollow spout portion of said center funnel including an inwardly tapered portion, having upper and lower ends, at said upper end thereof;

(i) said upper end of said inwardly tapered portion of said spout portion of said center funnel being joined to said lower end of said stem portion thereof to define an exterior shoulder therebetween;

(j) said lower end of said spout portion of said center funnel being inwardly tapered;

(k) a plurality of elongated and radially spaced-apart openings, having upper and lower ends, formed in said stem portion;

said exterior shoulder between said lower end of said stem portion of said center funnel and said tapered portion of said spout portion of said center funnel engaging said interior surface of said spout of said outer reservoir funnel to limit the downward movement of said center funnel with respect to said outer reservoir funnel to an operative fill position;

when said center funnel is in said operative fill position:

(a) said cone-shaped portions of said outer reservoir funnel and said center funnel are spaced-apart;

(b) said exterior shoulder preventing overfill fluid from passing upwardly from said lower end of said tapered spout of said outer reservoir funnel;

(c) said openings in said stem portion permitting overfill liquid to pass outwardly therethrough into said lower end of said cone-shaped portion of said outer reservoir funnel thereby preventing liquid from being spilled.

4. The anti-spill funnel of claim 3 wherein a plurality of elongated and radially spaced-apart second ribs, having upper and lower ends, extend outwardly from said outer surface of said cone-shaped portion of said center funnel, at said lower end thereof, and said outer surface of said hollow stem portion at said upper end thereof and wherein upper ends of said first ribs have a greater thickness than said lower ends thereof.

* * * * *